US006520389B1

(12) United States Patent
Bowman

(10) Patent No.: US 6,520,389 B1
(45) Date of Patent: Feb. 18, 2003

(54) QUILTING NEEDLE

(76) Inventor: Beverly W. Bowman, 4114 38th Ave. West, Bradenton, FL (US) 34205

( * ) Notice: Subject to any disclaimer, the term of this patent is extended or adjusted under 35 U.S.C. 154(b) by 0 days.

(21) Appl. No.: 10/108,536

(22) Filed: Mar. 27, 2002

(51) Int. Cl.[7] ..... D05B 85/00
(52) U.S. Cl. ..... 223/102; 112/202; 163/1
(58) Field of Search ..... 223/102; 112/202; 163/1–7

(56) References Cited

U.S. PATENT DOCUMENTS

| | | | | |
|---|---|---|---|---|
| 11,769 A | * | 10/1854 | Wilcox et al. | 112/222 |
| 2,258,925 A | | 10/1941 | Burg | |
| 2,378,544 A | | 6/1945 | Fosse | |
| 2,922,420 A | | 1/1960 | Cheng | |
| 3,678,712 A | * | 7/1972 | Singleton | 223/102 |
| 4,608,939 A | | 9/1986 | Lampley | |
| 4,616,770 A | | 10/1986 | Johns | |
| 5,409,004 A | | 4/1995 | Sloan | |
| D404,907 S | | 2/1999 | Vincente | |
| D413,431 S | | 9/1999 | Allender | |

* cited by examiner

*Primary Examiner*—John J. Calvert
*Assistant Examiner*—James G Smith
(74) *Attorney, Agent, or Firm*—Charles J. Prescott

(57) ABSTRACT

A quilting needle for achieving substantially uniform stitches in a multi-layer fabric/batten quilting substrate. The needle is formed as an elongated straight slender needle body having an eyelet at one end thereof sized for receiving a quilting thread therethrough and a sharp quilting fabric piercing point at another end of the needle body. A viewable stitch size guide is permanently disposed on the needle body so as not to disrupt the smooth needle body surface and is positioned from the point a distance equal to a desired stitch size. Successive stitches formed into the substrate of uniform size or length when the needle body is consistently pierced through the substrate to a depth defined when said stitch size guide just touches or meets and aligns with an obverse surface of the substrate before piercing the point into a reverse surface of the substrate to complete each stitch.

3 Claims, 3 Drawing Sheets

FIG 5A
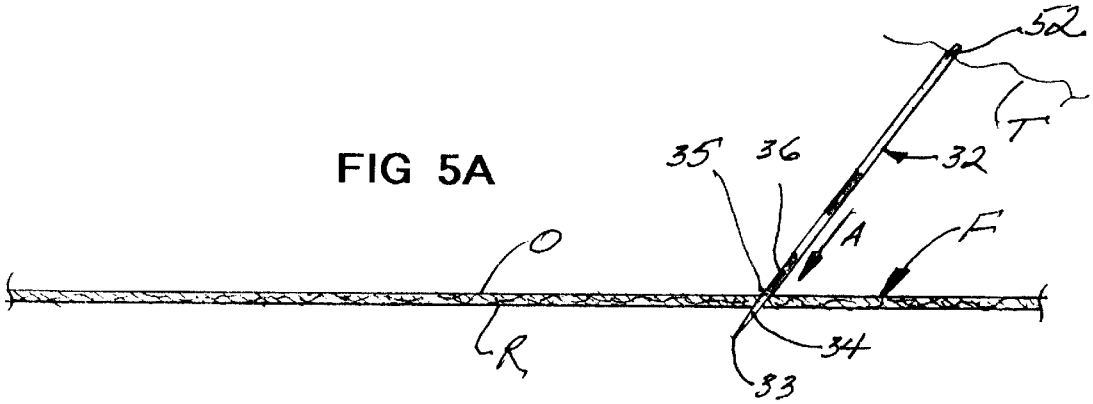
FIG 5B
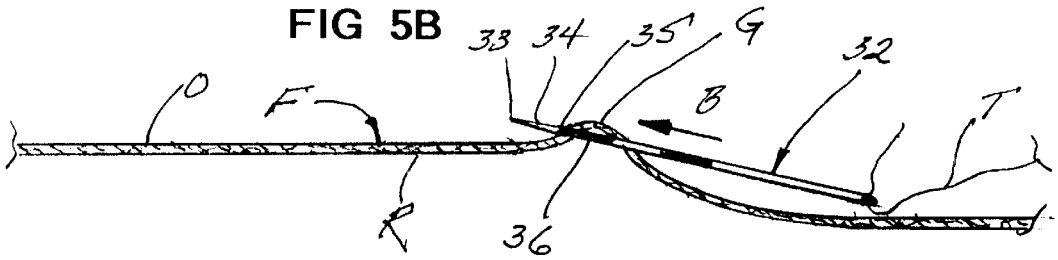
FIG 5C
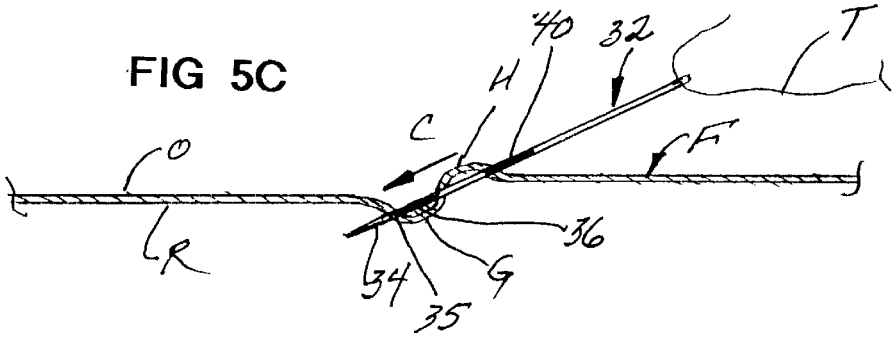
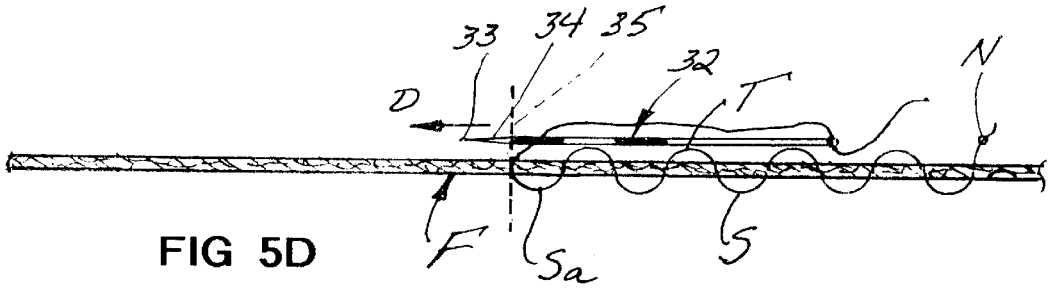
FIG 5D

QUILTING NEEDLE

BACKGROUND OF THE INVENTION

1. Scope of Invention

This invention relates generally to needles used for sewing and quilting, and more particularly to a quilting needle which provides a viewable indicia to achieve smaller and more consistent stitch sizing.

2. Prior Art

The art of quilting involves stitching, sewing or covering with lines or patterns through multiple layers of cloth or fabric material between which a padding or batten is positioned to form an intermediate layer for added thickness, padding and warmth. Quilting needles are used to apply the hand stitching to achieve the finished product which is typically at least three layers of sandwiched batten layer surrounded on either side by a flexible fabric material of choice. These multi-layers are first basted together with large stitches and then quilt-stitched with much smaller and ideally uniformly sized stitches for achieving a finished, durable product.

The art of quilting is enhanced when many, if not all, of the quilting stitches are relatively small and uniform in size. A basting stitch might be on the order to ¼" to ½" in length, whereas a small fine quality quilting stitch might be on the order of ⅛" or in the range of ten quilting stitches per inch.

Several variables associated with quilting affect the desired quality of uniform stitch size, including the size of the needle, the ability of the quilter to maintain stitch size and evenness, and the thickness of the batting layer. Because the batting or intermediate layer of the multi-layered substrate to be quilted comes in various thicknesses, the consistency of substrate compression during each stitch will affect the ultimate outcome of consistency.

A quilting tool invented by Johns and disclosed in U.S. Pat. No. 4,616,770 is there described which facilitates making stitches of uniform size and consistency. This quilting tool includes an elongated handle portion and a spoon-shaped portion which is utilized to form a small ridge in the fabric through which the quilting needle is easily passed.

Lampley, in U.S. Pat. No. 4,608,939 teaches a quilting or sewing guide in the form of a pattern or template positioned against both the reverse and obverse side of the multi-layer substrate and having aligned perforations through each of the templates through which the stitches are formed. Because the perforations are evenly spaced apart, the stitch consistency is achieved.

The following additional prior art devices are known to applicant which are, in some way, intended to facilitate the sewing or knitting process.

U.S. Pat. No. 2,258,925 to Burg
U.S. Pat. No. 2,378,544 to Fosse
U.S. Pat. No. 5,409,004 to Sloan
U.S. Pat. No. D413,431 to Allender
U.S. Pat. No. D404,907 to Vincente
U.S. Pat. No. 2,922,420 to Cheng The present invention provides a uniquely permanently marked quilting needle utilized for hand basting and quilting of the multi-layer quilting substrate to achieve even stitch size regardless of the ability of the quilter, needle size or batting thickness. Permanent viewable indicia are applied along the length of the quilting needle at a specific distance from the needlepoint. By utilizing this marking or indicia, the quilter will consistently recognize the correct needle depth into or from the quilting substrate, at which point the needle is then pierced back through the substrate to complete the stitch or to start the next stitch. Multiple marks may be placed along the length of the needle body at specific desired distances from the point of the needle to allow the quilter to consistently implement more than one stitch size such as when basting the multi-layer quilt substrate together.

BRIEF SUMMARY OF THE INVENTION

This invention is directed to a quilting needle for achieving substantially uniform stitches in a multi-layer fabric/batten quilting substrate. The needle is formed as an elongated straight slender needle body having an eyelet at one end thereof sized for receiving a quilting thread therethrough and a sharp quilting fabric piercing point at another end of the needle body. A viewable stitch size guide is permanently disposed on the needle body so as not to disrupt the smooth needle body surface and is positioned from the point a distance equal to a desired stitch size. Successive stitches formed into the substrate of uniform size or length when the needle body is consistently pierced through the substrate to a depth defined when said stitch size guide just touches or meets and aligns with an obverse surface of the substrate before piercing the point into a reverse surface of the substrate to complete each stitch.

It is therefore an object of this invention to provide a quilting needle which will facilitate accurate stitch size placement in a multi-layer quilting substrate.

It is another object of this invention to enhance the quilting stitch consistency of a quilter such as someone just beginning to develop such skills.

It is still another object of this invention to provide a quilting needle with viewable indicia disposed thereon which will facilitate the placement of more than one stitch length consistently into a multi-layer quilting substrate.

In accordance with these and other objects which will become apparent hereinafter, the instant invention will now be described with reference to the accompanying drawings.

BRIEF DESCRIPTION OF THE DRAWINGS

FIGS. 5*a* to 5*d* sequentially demonstrate the use of the invention as shown in FIG. 3.

DETAILED DESCRIPTION OF THE INVENTION

Figure 1:
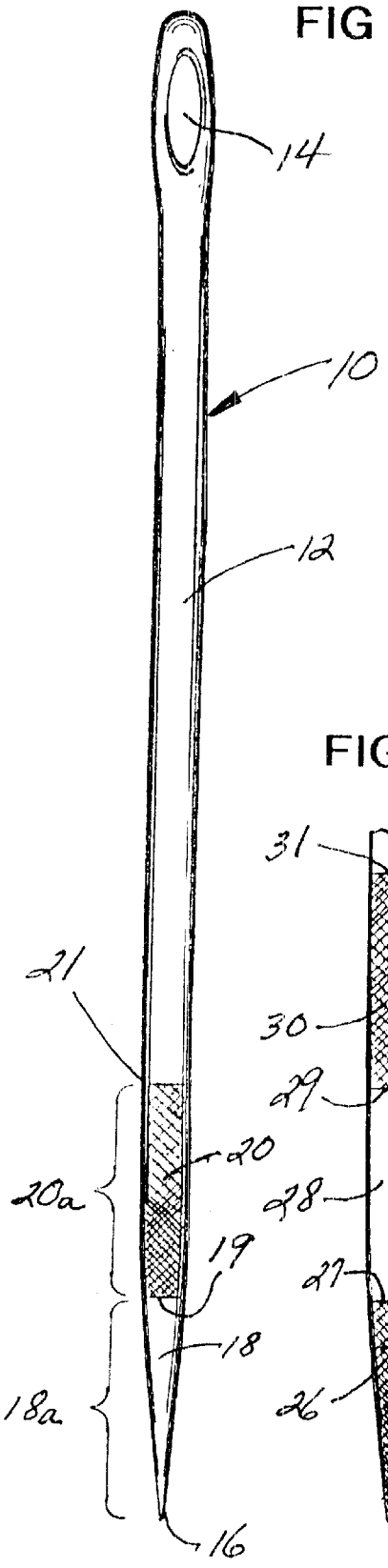
FIG. 1 is a side elevation view of one embodiment of the invention.

Referring now to the drawings and particularly to FIGS. 1 to 4, one embodiment of the invention is shown in FIG. 1, generally at numeral 10. This embodiment 10 includes an elongated straight, slender needle body 12 which is selected in size to be particularly useful to the art of quilting. This needle 10 includes an eyelet 14 formed at one end thereof and a sharpened point 16 disposed at the other end of the needle body 12. Again, the overall size and configuration of the quilting needle 10 is of a conventional nature depending on the skill and preference of the quilter.

A viewable stitch size indicia or band 20 is applied circumferentially around the needle body 12. Importantly, the viewable indicia or band 20 is permanently attached to or dyed into the material forming needle body 12 such as by permanently indelible ink, etching, particle abrasion and the like which does not substantially interrupt the smooth continuous cylindrical outer surface of the needle 10. The preferred method of applying the band 20 is by heat-bonding a band of paint which will permanently fuse the paint band into the porous material forming the needle.

By providing a viewable indicia or band 20 having a length 20*a*, two stitch size marks or edges are provided at 19 and 21 which are disposed a specific length from the point 16 of the quilting needle 10. The very distal portion 18 of the quilting needle 10 is uncoated over a length 18*a*, while the indicia or band 20 is viewably distinct either by color or surface texturing to appear substantially differently so that either of the marks or edges 19 or 21 is quickly discernable during the quilting process and as better described herebelow with respect to FIGS. 6*a*, 6*b* and 6*c*.

Figure 2:
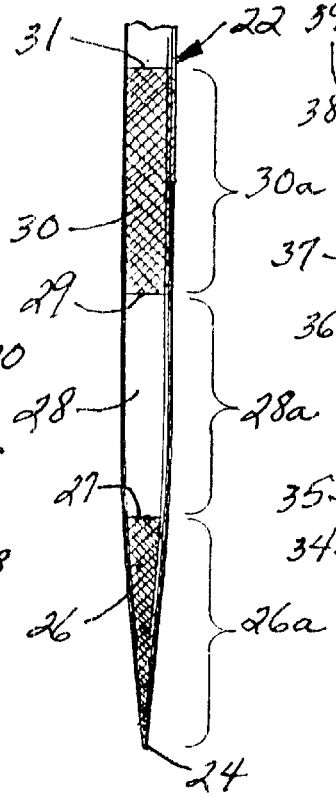
FIGS. 2, 3 and 4 are partial views similar to FIG. 1 showing alternate embodiments of the invention.

In FIG. 2, another embodiment of the invention is there shown at 22. This embodiment 22 includes two spaced sections of viewable surface indicia 26 and 30. Area 26 has a length of 26*a* terminating at 27, while area has a length 30*a* which extends between edges 29 and 31. Each of these viewably distinct edges 27, 29 and 31 define separate stitch length opportunities for consistently applying a quilting stitch into a multilayer substrate of different stitch lengths. The shorter stitch length would be applied utilizing edge 27, an intermediate quilting stitch length would be utilized using edge 29, while the longest of the quilting stitches available utilizing this embodiment 22 would be by utilizing edge 31. It is here noted that the typical length of quilting or sewing stitches which are encountered by a quilter or seamstress are in the range of as small as 10 to 12 stitches per inch all the way up to large basting stitches which extend up to ½" and even beyond at the user's choice.

Figure 3:
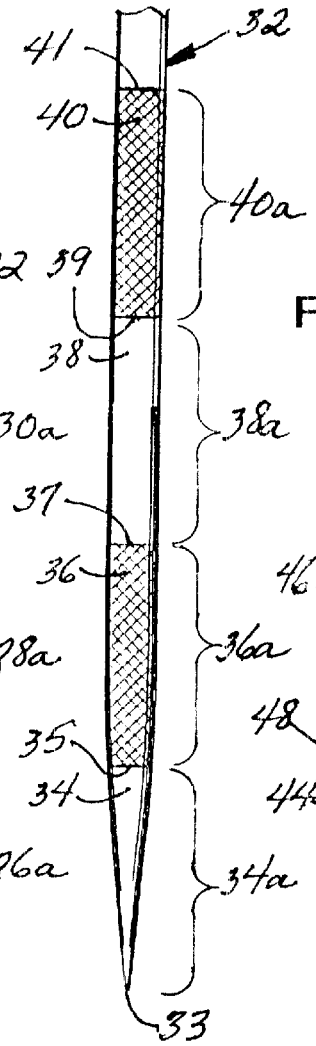

In FIG. 3, another embodiment 32 is there shown. In this embodiment 32, the distal end portion 34 of the quilting needle 32 is unmarked while two spaced bands or indicia 36 and 40 are applied in spaced apart fashion on either end of unmarked portion 38 in an amount equal to 38*a* of the unmarked or uncoated section 38. In this embodiment then, four separate quilting stitch size indicia at edges 35, 37, 39 and 41 are provided. Thus, the quilter would predetermine the length of a particular quilting stitch to be applied and then choose the appropriate mark or indicia 35, 37, 39, or 41 to begin to apply the quilting stitches of that length uniformly. Note that, through the utilization of only one needle marked within the scope of this invention, the quilter or seamstress is afforded the ability to select the stitch length at will, depending upon the particular area of the quilting process currently receiving attention.

Figure 4:
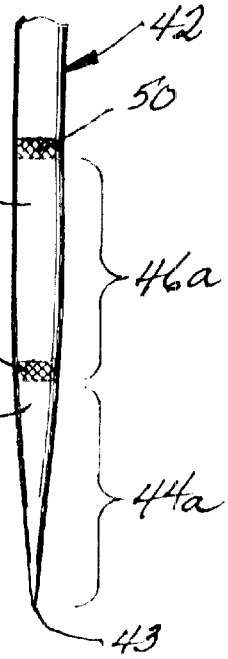

In FIG. 4, this embodiment 42 includes very narrow bands 48 and 50 of viewable indicia which may be preferred by some quilters. In this embodiment, the quilter would generally utilize each of these narrow bands or indicia 48 and 50 (⅛" or less) which are spaced from the tip 43 in amounts generally equal to 44*a* and 46*a* as desired. The distal tip portion 44 and the needle section 46 are unmarked.

Referring now to FIGS. 5A to 5D, the steps of applying stitching into a multi-layer quilting substrate shown generally at numeral F are there demonstrated with the embodiment 32 shown in FIG. 3. A length of thread T has been inserted through the eyelet 52 prior to commencement in FIG. 5*a*. The point 33 is first pierced through the obverse surface O of substrate F in the direction of arrow A a distance such that edge 35 of the indicia or band 36 just comes in contact, or is in alignment, with the obverse surface O. Note that the obverse surface O referred to herein is that which is viewed by, and facing the quilter. The reverse side R is referred to as the lower surface which would be downwardly facing and not directly viewable by the quilter.

In FIG. 5*b*, the quilting needle 32 has been rotated clockwise as viewed so as to bend the substrate F at G so as to compress the thickness of the substrate F before the tip 33 and distal portion 34 are pierced upwardly through the substrate F by movement of the quilting needle 32 in the-direction of arrow B.

In FIG. 5*c*, the quilting needle 32 is rotated in the opposite direction or counterclockwise as viewed with the stitch size mark 35 just starting to extend from the obverse surface O of FIG. 5*b*. The quilting needle 32 is then moved in the direction of arrow C a distance so that stitch size mark 35 is again just touching the obverse surface O. By repeating this process, the installation of several uniform stitches F of the thread T which are generally of uniform consistency are installed into the substrate F.

By knotting the distal end of thread T at N as shown in FIG. 5D, the user may then pull the needle 32 in the direction of arrow D to tighten and secure those stitches S, after which further stitch installation will continue. The stitch size mark 35 is shown projected orthogonally to the length of the needle 34 when held parallel to and in close proximity above the substrate F. This needle placement provides an accurate needle positioning with respect to the last stitch Sa so that the point 33 thereby re-pierces the substrate F for accurate stitch sizing of the next stitch after the previous set of stitches have been tightened.

Figure 6A:
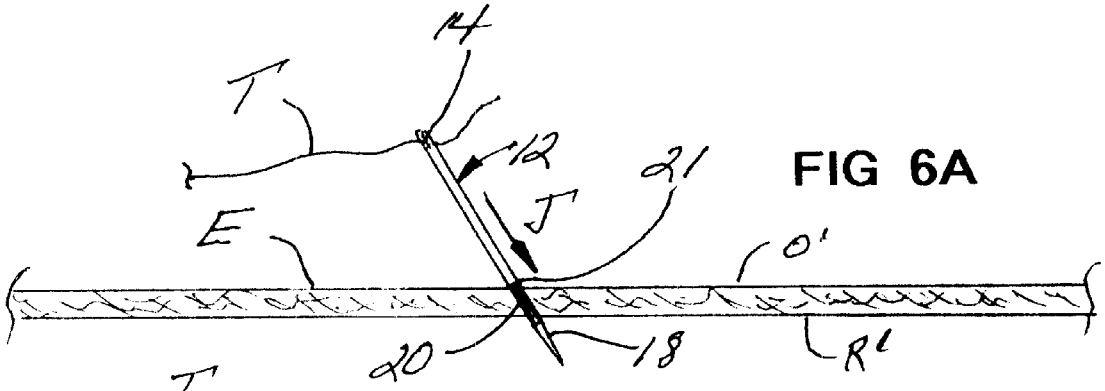
FIGS. 6*a* to 6*c* show the stitching sequence utilizing the embodiment of FIG. 1 with respect to a thicker multi-layer quilting substrate.
Figure 6B:
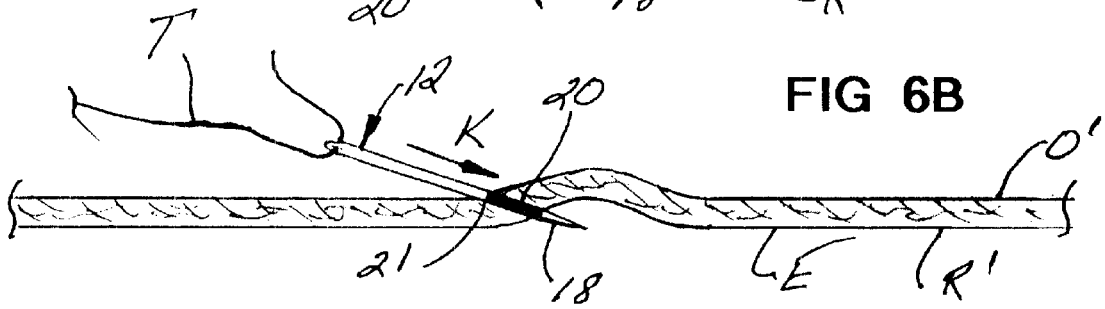
Figure 6C:
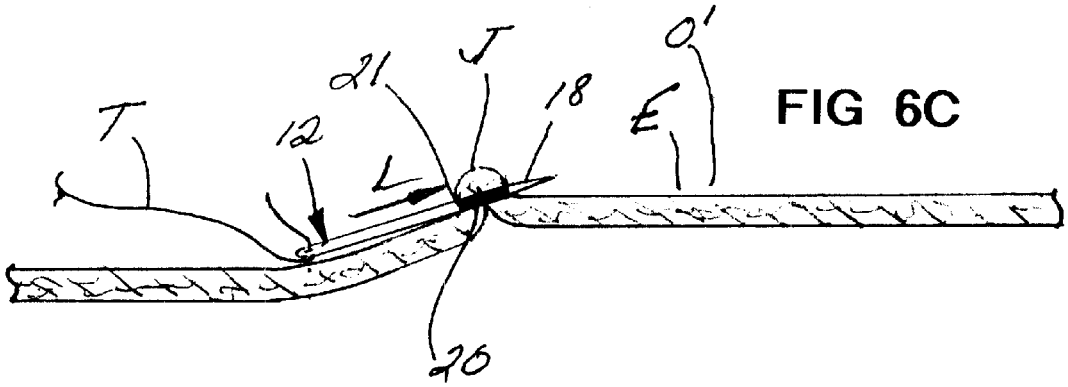

Referring now to FIGS. 6*a*, 6*b* and 6*c*, the quilting needle 12 previously described in FIG. 1 is being sequentially utilized to apply a quilting stitch into a thicker multi-layer substrate E. A thread T has been installed through the eyelet 14 prior to piercing the quilting needle 12 downwardly through the obverse surface O' and through the reverse surface R' therebelow. Movement of the quilting needle 12 is stopped when one of the desired markings, e.g. 21 just comes in contact with the obverse service O' in FIG. 6*a*.

In FIG. 6*b*, the needle 12 is then twisted or rotated counterclockwise as viewed in FIG. 6*b* so as to bend the substrate E as shown. Thereafter, as seen in FIG. 6*c*, the distal portion 18 of the quilting needle 12 is pierced through the reverse surface R' and upwardly through the obverse surface O' after the quilting needle 12 has been sufficiently rotated counterclockwise to form the bend J. The quilting needle 12 is then moved in the direction of arrow L until the stitch size mark 21 again just touches or comes into alignment with the obverse surface O'.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A quilting needle for achieving substantially uniform stitches in a multi-layer substrate, comprising:

an elongated straight slender needle body having a substantially cylindrically continuous, uninterrupted outer surface and an eyelet formed at one end thereof sized for receiving a quilting thread there through and a sharp quilting fabric piercing point at another end of said needle body;

a viewable stitch size guide permanently disposed on said needle body without substantially interrupting the diameter of the outer surface and positioned from said point a distance equal to a desired stitch size whereby successive stitches formed into the substrate are substantially uniform in size when said needle body, with quilting thread through said eyelet, is consistently pierced through the substrate to a depth defined when said stitch size guide just meets and aligns with an obverse surface of said substrate before piercing said point into a reverse surface of the substrate to complete each stitch.

2. A quilting needle for achieving substantially uniform stitches in a multi-layer fabric/batten substrate, comprising:

an elongated straight slender needle body having an eyelet formed at one end thereof sized for receiving a quilting thread there through and a sharp quilting fabric piercing point at another end of said needle body;

a viewable stitch size indicia disposed on said needle body without substantially altering the diameter thereof and positioned from said point a distance equal to a desired stitch size whereby successive stitches formed into the substrate are substantially uniform in size when said needle body, with quilting thread through said eyelet, is consistently pierced through the substrate to a depth defined as being when said indicia just meets and aligns with an obverse surface of said substrate before piercing said point into a reverse surface of the substrate to complete each stitch.

3. A quilting needle for achieving substantially uniform stitches in a multilayer substrate, comprising:

an elongated straight slender needle body having a cylindrical surface and an eyelet formed at one end thereof sized for receiving a quilting thread there through and a sharp quilting fabric piercing point at another end of said needle body;

a plurality of spaced apart rings each of which is imprinted on said needle body so as not to substantially alter the diameter of the cylindrical surface thereby and positioned from said point a different distance equal to a desired stitch size whereby successive stitches formed into the substrate are substantially uniform in size when said needle body, with quilting thread through said eyelet, is consistently pierced through the substrate to a depth defined as being when one of said rings just meets and aligns with an obverse surface of said substrate before piercing said point Into a reverse surface of the substrate to complete each stitch.

* * * * *